United States Patent [19]

Thünker

[11] 4,295,422

[45] Oct. 20, 1981

[54] CAMLESS DRIVE OF A SWINGING PRE-GRIPPER FEEDER

[75] Inventor: Norbert Thünker, Grossachsen, Fed. Rep. of Germany

[73] Assignee: Heidelberger Druckmaschinen Aktiengesellschaft, Heidelberg, Fed. Rep. of Germany

[21] Appl. No.: 52,257

[22] Filed: Jun. 26, 1979

[30] Foreign Application Priority Data

Jun. 26, 1978 [EP] European Pat. Off. ..... 78/00234.0

[51] Int. Cl.[3] ..... B41F 21/05; B65H 5/10; B65H 5/14

[52] U.S. Cl. ..... 101/232; 101/246; 101/409; 271/267

[58] Field of Search ..... 101/409, 410, 411, 246, 101/408, 232; 271/82, 85, 204, 267, 268, 277, 10

[56] References Cited

FOREIGN PATENT DOCUMENTS

| | | | |
|---|---|---|---|
| 687856 | 2/1940 | Fed. Rep. of Germany | 101/409 |
| 7131281 | 8/1971 | Fed. Rep. of Germany | 101/409 |
| 2557866 | 6/1977 | Fed. Rep. of Germany | 101/411 |
| 945188 | 12/1963 | United Kingdom | 271/82 |

*Primary Examiner*—J. Reed Fisher
*Attorney, Agent, or Firm*—Herbert L. Lerner

[57] ABSTRACT

Camless drive of an oscillating pregripper feeder for a sheet-fed rotary printing machine having a feed table, an impression cylinder and an oscillating pregripper feeder disposed between the feed table and the impression cylinder, the camless drive including a seven-bar linkage transmission system, the bars of which are articulatingly connected to one another solely by pivot joints, two cranks connected to the transmission system and revolvable at the same angular velocity for driving the transmission system, one of the linkages forming at least part of a pregripper of the oscillating pregripper feeder, the one linkage being disposed directly behind one of the cranks, the oscillating pregripper feeder having means for gripping a sheet to be printed which lies on the feed table, and the seven-bar linkage transmission system being actuatable by the cranks for transporting the gripped sheet along a given path directly to the impression cylinder.

3 Claims, 2 Drawing Figures

CAMLESS DRIVE OF A SWINGING PRE-GRIPPER FEEDER

Figure 1:
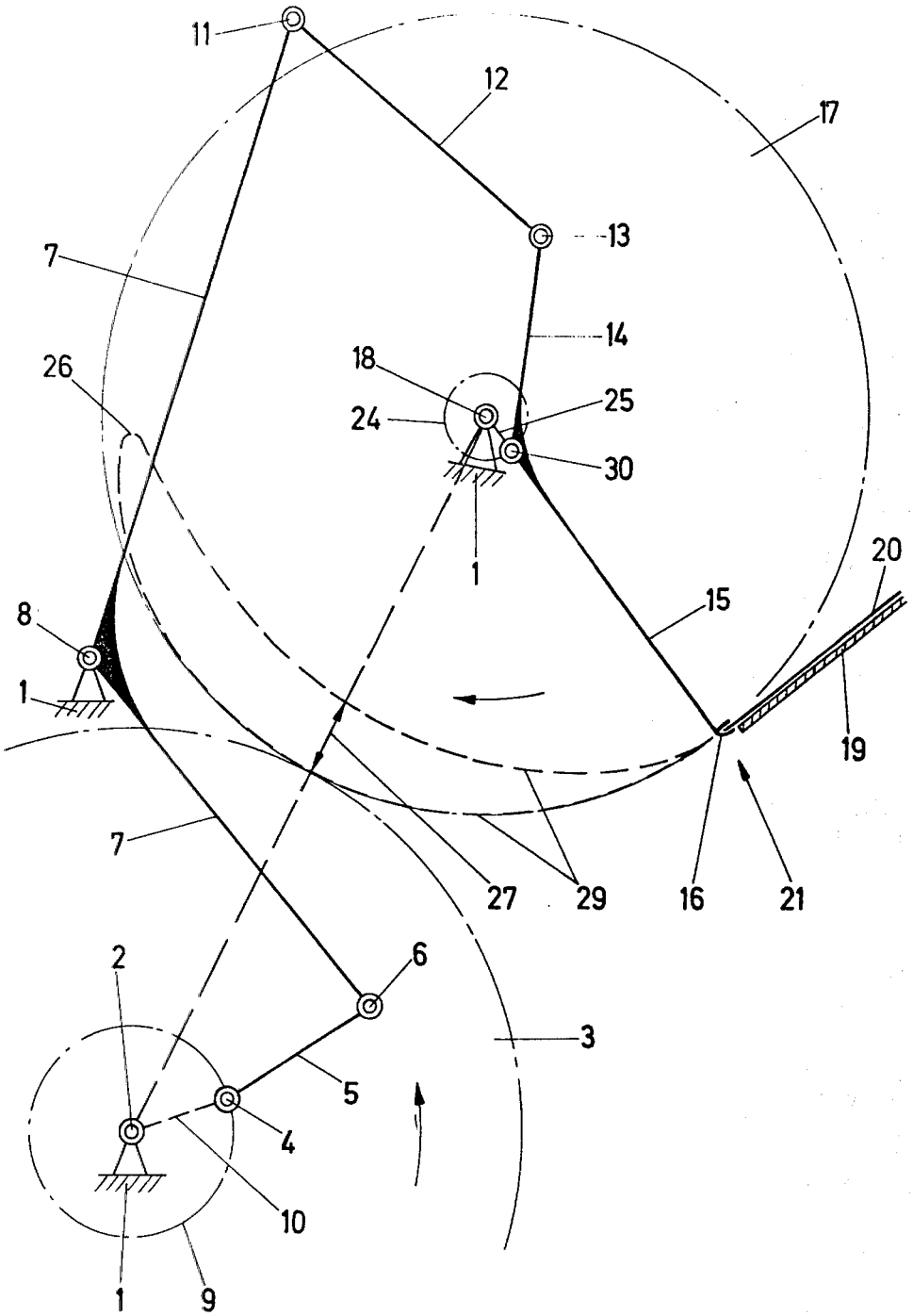

The invention relates to a camless drive of a swinging or oscillating preliminary gripper or pregripper, for sheet-fed rotary printing machines, the drive elements thereof being connected exclusively by swivel joints.

It is an objective of the invention to provide a camless drive of a swinging pregripper which grips with proper register a sheet which has been suitably oriented on the feed table and, after a brief interval, transfers it to the gripper set of the impression cylinder, the velocity conditions of the pregripper especially in both significant positions thereof, namely the sheet receiving position thereof wherein the velocity=0, and the sheet transfer position thereof wherein the velocity of the pregripper equals the velocity of the impression cylinder, are to be maintained exactly.

In the state of the art, only swinging pregrippres have become known heretofore which are driven either without cams by means of linkage, in which case no lift-off is permitted thereby during the return swing of the pregripper, or only with cam controls or cam-controlled coupler transmissions, in which case lift-off movement is effected during the return swing of the pregripper.

In German Petty Patent DE-Gbm No. 71 31 281, there is described a camless swinging or oscillating pregripper driven by a sliding pin drive or sliding block. Since this heretofore known construction does not, however, permit any lift-off movement during the return swing of the pregripper to the sheet receiving portion thereof at the feedtable and, moreover, since the length of time between the sheet transfer to the impression cylinder and the return swing of the pregripper is very brief, this device of the German petty patent requires an extremely wide channel or gap of 200° to be provided in the impression cylinder whereby the length of the maximal format to be used is sharply restricted. Even disregarding the foregoing, poor transmission conditions are provided for this pregripper device due to the small transmission angle thereof.

With regards to the drive of a swinging pregripper disclosed in German Pat. No. 22 20 343, it is noted that the device described therein is provided with force-lockingly cooperating drive elements. During operation, a lever arm is continuously pressed against a roller, through the intermediary of a cam control by a spring. The disadvantageous force lock is therefore sought to be compensated for by introducing a cam control, which causes the construction costs to increase accordingly. Furthermore, the components involved in the forcelock are bound to be subjected to very great loads or stresses due to the great inertial forces resulting from the high angular velocities and accelerations of the pregripper.

Although complex cam-controlled drives may be provided for lifting off swing grippers during the return swing to the sheet receiving position thereof, due to the required great deceleration of the pregripper from a relatively high velocity down to the sheet receiving velocity v=0, strong springs must also be provided to prevent the roller from lifting off the cam member so as, thereby, to assure a trouble-free force lock. In addition, manufacture of the cam plates used for the foregoing purpose is extremely expensive and complex.

It is accordingly an object of the invention to provide a drive of a swinging pregripper feeder for a short cylinder gap exploiting a wide range of format sizes which, on the one hand, is driven without cams and thereby eliminates the foregoing disadvantages of the relatively costly cam drives and, on the other hand, effects a return swing to the sheet receiving position thereof along a path spaced from the surface of the impression cylinder, whereby high machine velocities are to be attained. In this regard, care should be taken, especially, to ensure good transmission conditions i.e. transmission angles, at the drive elements, and to keep the space required to a minimum.

With the foregoing and other objects in view, there is provided, in accordance with the invention, a camless drive of an oscillating pregripper feeder for a sheet-fed rotary printing machine having a feed table, an impression cylinder and an oscillating pregripper feeder disposed between the feed table and the impression cylinder, the camless drive comprising a seven-bar linkage transmission system, the bars of which are articulatingly connected to one another solely by pivot joints, two cranks connected to the transmission system and revolvable at the same angular velocity for driving the transmission system, one of the linkages forming at least part of a pregripper of the oscillating pregripper feeder the one linkage being disposed directly behind one of the cranks, the oscillating pregripper feeder having means for gripping a sheet to be printed which lies on the feed table, and the seven-bar linkage transmission system being actuatable by the cranks for transporting the gripped sheet along a given path directly to the impression cylinder.

With such a drive according to the invention, the gap of the impression cylinder can be kept extremely short and, thereby correspondingly increase the peripheral area available for sheet engagement so that the use of larger formats for the same impression-cylinder diameter is afforded. Furthermore, relatively high machine speeds can be employed due to favorable transmission conditions.

In accordance with another feature of the invention, one of the pivot joints for one of the bars is connected by the one bar to a driven member of a rocker arm whereby an oscillating movement is imparted to the pregripper, and another of the pivot joints for the one bar is guidable, eccentrically revolving, in a circular path, whereby the pregripper, during the return swing of the oscillation thereof, experiences a lift-off from the impression cylinder and returns along a path spaced away from the given path to a position thereof at the feed table whereat the gripping means had gripped the sheet. Such a device according to the invention is relatively simple and inexpensive to manufacture, and the dynamics thereof can be well controlled. That is why, even for high machine speeds and extremely brief time intervals during which sheet transfer is effected to the impression cylinder, the exact maintenance of the desired velocity conditions of the pregripper during the sheet reception at the feed table and the sheet transfer at the impression cylinder is assured. The result thereof is absolutely exact register when the sheet is transferred from the feed table to the impression cylinder.

In accordance with a concomitant feature of the invention a first gear is journalled concentrically to the impression cylinder on a stationary frame of the printing machine, a second gear is journalled on the machine frame between and above the feed table and the impression cylinder and meshes with the first gear so that both gears are rotatable at the same angular velocity, a pivot joint of one of the cranks is carried by the first gears and is revolvable therewith, and a pivot joint of the other of the cranks is carried by the second gear and is revolvable therewith.

Other features which are considered as characteristic for the invention are set forth in the appended claims.

Although the invention is illustrated and described herein as embodied in a camless drive of a swinging pre-gripper feeder, it is nevertheless not intended to be limited to the details shown, since various modifications and structural changes may be made therein without departing from the spirit of the invention and within the scope and range of equivalents of the claims.

Figure 2:
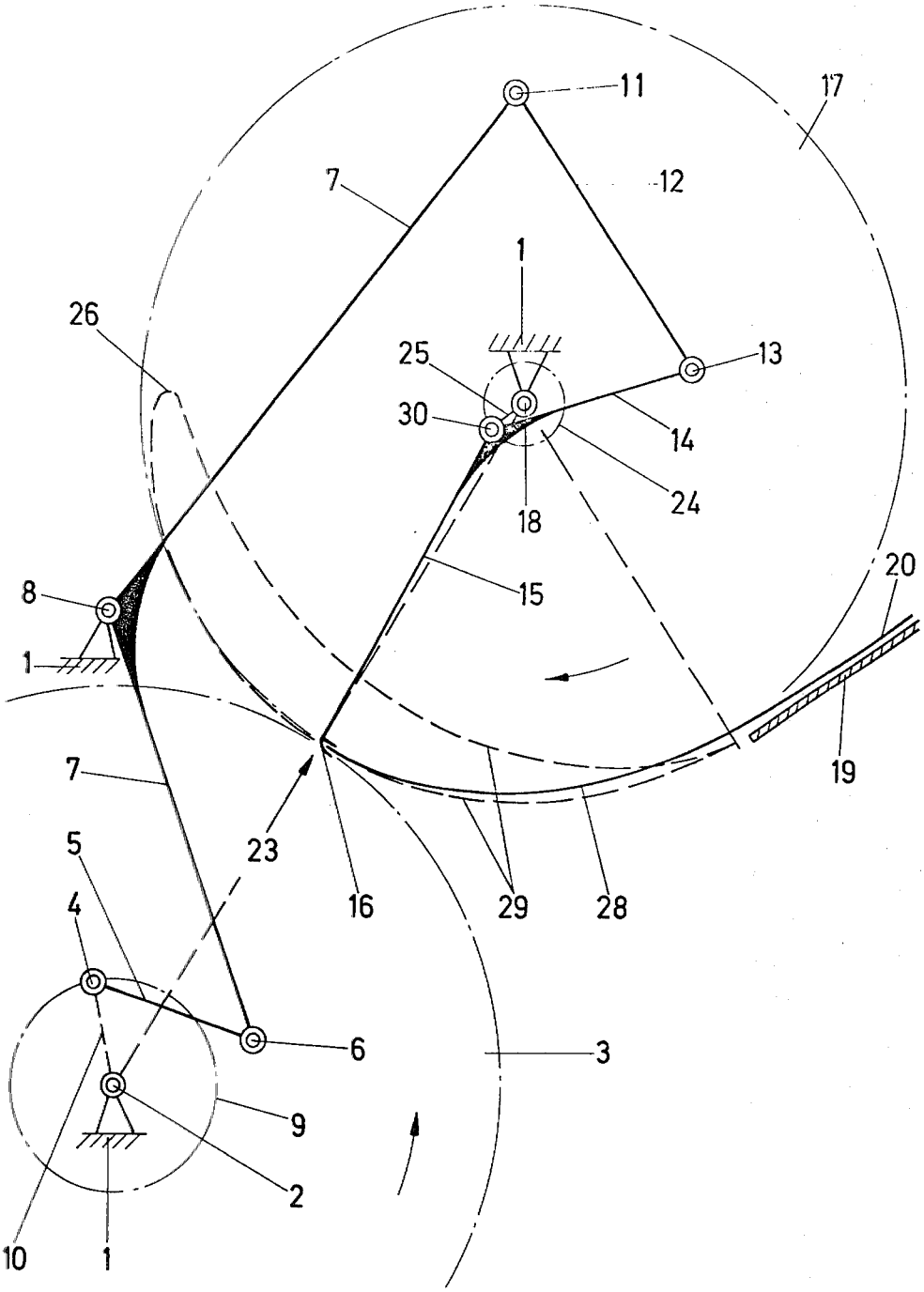

The construction and method of operation of the invention, however, together with additional objects and advantages thereof will be best understood from the following description of specific embodiments when read in connection the the accompanying drawings, in which:

FIG. 1 is a diagrammatic and schematic side view of the camless drive of a swinging pregripper feeder according to the invention, wherein the pregripper is shown in sheet receiving position at a feed table; and FIG. 2 is a view similar to that of FIG. 1, but wherein the pregripper is shown in sheet transfer position at impression cylinder.

Referring now to the figures of the drawing, there is shown therein a first gear 3 rotatably mounted in a machine frame 1 at a frame point 2 coextensive or coinciding with the axis of an impression cylinder. The gear 3 is identical with the drive wheel of the impression cylinder. A coupler 5 is articulatingly connected to a crank point 4 at an eccentric location in the gear 3, the coupler 5 being a connecting element through a pivot point 6 to a driven element 7 articulatingly mounted at a frame or fixed point 8. The driven element 7 mounted at the fixed articulating point or joint 8 is constructed as a double-armed rocking lever. The crank lever mechanism 2, 4, 6, 8 is driven by the crank joint 4 which travels along a circular path 9 when the gear 3 rotates, the radius of the circular path 9 being the length of the drive crank 10 for the swinging movement of the pregripper 16.

A coupler 12 is articulatingly connected to the free end of the swing or swivel lever 7, the coupler 12 transmitting the swinging movement of the swing lever 7 through a joint or pivot point 13 to a pregripper lever 14. A coupler, namely a pregripper carrier 15, is firmly connected to the pregripper lever 14. Pregrippers 16 per se are located at the free end of the pregripper carrier 15 which is eccentrically and rotatably mounted at a pivot point 30 of a second gear 17.

The gear 17 mounted at the fixed or frame point 18 meshes with the first gear 3 and rotates at the same angular velocity as the latter.

The operation of the hereinaforedescribed camless drive of a swinging pregripper feeder according to the invention is explained in greater detail hereinafter:

A sheet 20 lying on a sheet feed table 19 is gripped by the pregripper 16 in the sheet receiving position thereof shown in FIG. 1. The gripping surface or seat of the pregripper 16, at the location thereof shown in FIG. 1, has exactly the velocity $v=0$. Due to the rotational movement of the first gear 3, such a movement is imparted to the coupler transmission 2, 4, 6, 8, 11, 13, 30 through the drive crank 10 that the pregripper carrier 15 is pivoted and, after only a brief time period, attains in the sheet transfer position at 23 the velocity necessary for sheet transfer to the impression cylinder, namely exactly the circumferential velocity of the cylinder (FIG. 2).

Due to the movement of the pivot point or articulating joint 30 of the pregripper carrier 15 along a circular path represented by the dot-dash line 24 around the frame point or fixed point 18, which serves simultaneously as the bearing point or rotational center for the gear 17, and due to the movement of the pivot point or articulating joint 13 of the pregripper lever 14, the necessary swinging or oscillating motion is imparted to the pregripper lever 14.

The radius of the circular path 24 serves as the drive crank 25 for the lift-off movement of the pregripper 16.

Following the transfer of the sheet to the impression cylinder, the pregripper carrier 15 continues to swing until the gripping surface or seat of the pregripper 16 has reached a reversal point 26.

During this continued swing of the pregripper carrier 15, a lift-off movement of the pregripper 16 up to a maximal lift-off 27 is initiated due to the guidance of the pivot point 30 along the circular path 24, so that the gripping surface or seat of the pregripper 16 is then swung back to the sheet receiving position 21 thereof along a path lying spaced from and higher than the surface of the impression cylinder, as viewed in the figures, and the sheet feed path 28 is contacted or crossed thereby only very much later, thereby making possible the use of very large formats, relative to the periphery of the impression cylinder.

In FIGS. 1 and 2, the curved path which describes the course of movement of the gripping surface or seat of the pregripper 16 during a revolution of the impression cylinder or of the pregripper drum is represented by a broken line 29. The extent of maximal lift-off 27 of the gripping surface or seat of the pregripper 16 from the sheet feed path 28 corresponds to the diameter of the circular path 24 described by the pivot point or articulating joint 30 during a revolution of the second gear 17.

From the foregoing, it is believed to be readily apparent that the invention of the instant application thus relates to a pregripper 16 which oscillates between a sheet feed table 19 and an impression cylinder of a sheet-fed rotary printing machine. The pregripper 16 takes possession of the sheet 20 in the starting position thereof, at rest, from the feed table 19 and guides it with a swinging movement to the impression cylinder. The swinging pregripper 16 is simultaneously accelerated to the velocity of the impression cylinder so that the sheet transfer per se is effected at the gripper set i.e. at the location 23 of the impression cylinder at relative rest or zero velocity between the impression cylinder and the swinging pregripper 16.

Of special significance for the velocity of a printing machine operating with such a swinging pregripper 16, is the fact that the swinging gripper 16 can return along a path which is not that along which it originally travels toward the impression cylinder. In such a case a pause must be introduced into the course of travel of the pregripper 16, which must be of such duration that the trailing edge of the sheet 20 transferred to the impression cylinder will have in the interim gone past the point of tangency of both gears 3 and 17, which is simultaneously the sheet transfer point 23, as shown in FIGS. 1 and 2. This has had a limiting effect upon any prior attempts to increase the velocity of such printing machines.

The primary inventive concept of the invention in the instant application is to provide an expedient, with respect to a velocity increase, whereby the swinging pregripper 16 can return more rapidly to the starting position thereof at the sheet feed table 19, actually when the sheet 20 transferred to the impression cylinder has not yet been fully withdrawn i.e. is located yet in the sheet feeding path 28.

This is achieved by the special construction of the coupler drive wherein it is of particular importance that both cranks 25 and 10 revolve at the same angular velocity, and the pregripper carrier 15 is connected directly after the crank 25. The lift off of the swinging pregripper 16 out of the sheet feeding path 28, which actually permits an increase in velocity of the printing machine, is achieved by the fact that the pivot point or articulating point 30 is simultaneously the revolving point of the crank 25 which is guided so as to revolve eccentrically in a circular path 24, the diameter of the circular path 24 corresponding to the extent of maximal lift-off 27 of the swinging pregripper. Thus, the pregripper 16 is permitted to swing back to the sheet receiving position 21 at the feed table 19 along a path above the sheet 20 which has not yet been withdrawn completely from the feed path 28 and which has also not yet come to lie completely on the impression cylinder.

As noted hereinbefore, deviations from the transmission construction shown in the figures and described herein as an embodiment of the invention are conceivable within the scope of the invention. For example, it is quite possible to locate the frame or fixed point 2 for the drive crank 10 at any other desired position i.e. not on the impression cylinder, by suitably varying the scale of the crank swing 2, 4, 6, 8 in accordance with whatever variation in the length of the frame may be necessary.

There are claimed:

1. Camless drive of an oscillating pregripper feeder for a sheet-fed rotary printing machine having a fixed frame and a feed table, an impression cylinder rotatably mounted on said fixed frame and an oscillating pregripper feeder disposed between the feed table and the impression cylinder, the camless drive comprising a miltibar linkage transmission system having bars mutually connected serially to one another and having pivot joints located at each of the mutual connections of said bars, two cranks articulatingly connected, on the one hand to the fixed frame and, on the other hand, to said transmission system and revolvable at the same angular velocity for driving said transmission system, one of said bars forming at least part of a pregripper of said oscillating pregripper feeder, said one bar being disposed directly behind and articulatingly connected to one of said cranks, said one bar being rigidly connected to a second bar, in turn, articulatingly connected by a coupler to a swing lever articulatingly connected to the fixed frame, said swing lever being drivingly swingable by a crank lever mechanism including the other of said two cranks, said oscillating pregripper feeder having means for gripping a sheet to be printed which lies on the feed table, and said multi-bar linkage transmission system being actuatable by said cranks for transporting the gripped sheet along a given path directly to the impression cylinder.

2. Camless drive according to claim 1 wherein a first gear comprises said other of said cranks and is journalled concentrically to the impression cylinder on a stationary frame of the printing machine, a second gear comprises said one of said cranks and is journalled on the machine frame between and above the feed table and the impression cylinder and meshes with the first gear so that both gears are rotatable at the same angular velocity, said other of said cranks having a pivot joint carried by said first gear and revolvable therewith, and the said one of said cranks having a pivot joint carried by said second gear and revolvable therewith.

3. Camless drive according to claim 1 wherein said one bar forms part of a rocker arm including said second bar, said second bar having one of said pivot joints thereof connected via a third bar to a crank swing whereby a swinging movement is imparted to said pregripper, said second bar having another pivot joint in common with a pivot joint of said one bar connected to said one crank and revolving in a circular path whereby said pregripper, during the return swing of the oscillation thereof, experiences a lift-off from the impression cylinder and returns along a path spaced away from said given path to a position thereof at the feed table whereat said gripping means had gripped the sheets.

* * * * *